United States Patent [19]

Zygaj

[11] Patent Number: 4,848,617

[45] Date of Patent: Jul. 18, 1989

[54] METHOD OF MAKING A HAZARDOUS WASTE SECONDARY STORAGE FACILITY

[75] Inventor: Jim Zygaj, Manistee, Mich.

[73] Assignee: Portable Containers, Inc., Manistee, Mich.

[21] Appl. No.: 202,900

[22] Filed: Jun. 6, 1988

[51] Int. Cl.[4] ..... B65D 90/00

[52] U.S. Cl. ..... 220/1.5; 220/DIG. 27

[58] Field of Search ..... 220/1 B, 1.5, 83, DIG. 27, 220/22

[56] References Cited

U.S. PATENT DOCUMENTS

| | | | |
|---|---|---|---|
| 3,647,100 | 3/1972 | Russel-French | 220/83 X |
| 3,868,042 | 2/1975 | Bodenheimer | 220/1.5 X |
| 4,122,761 | 10/1978 | Westin et al. | 220/1.5 X |

*Primary Examiner*—John Fox

*Attorney, Agent, or Firm*—Barnes, Kisselle, Raisch, Choate, Whittemore & Hulbert

[57] ABSTRACT

A method of making a portable hazardous waste storage facility preferably by converting a conventional shipping container. An air duct is placed inside or outside a conventional shipping container corrugation with an inlet located less than 12 inches from the container floor and an outlet for exhausting captured air outside to the atmosphere. A fan is provided for producing a positive air flow through the facility. To provide self containment or retainment of at least ten percent of the material stored in the facility, a threshold dam or retainment barrier is provided inside and across the bottom of the conventional entryway of the shipping container. Preferably, additional entryways with doors are provided, each with a threshold above the floor of the container at a sufficient height to at least meet the containment requirements. Preferably each entryway door has splash guard to prevent leakage around the closed door. Preferably all joints in the container are sealed to prevent leakage.

20 Claims, 4 Drawing Sheets

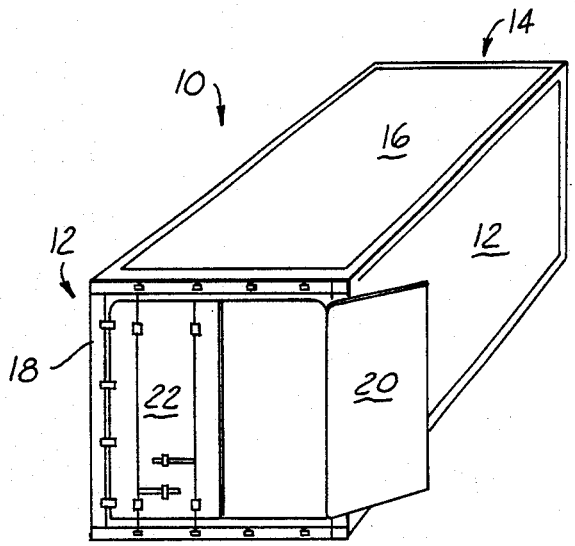
FIG. 1
FIG. 2
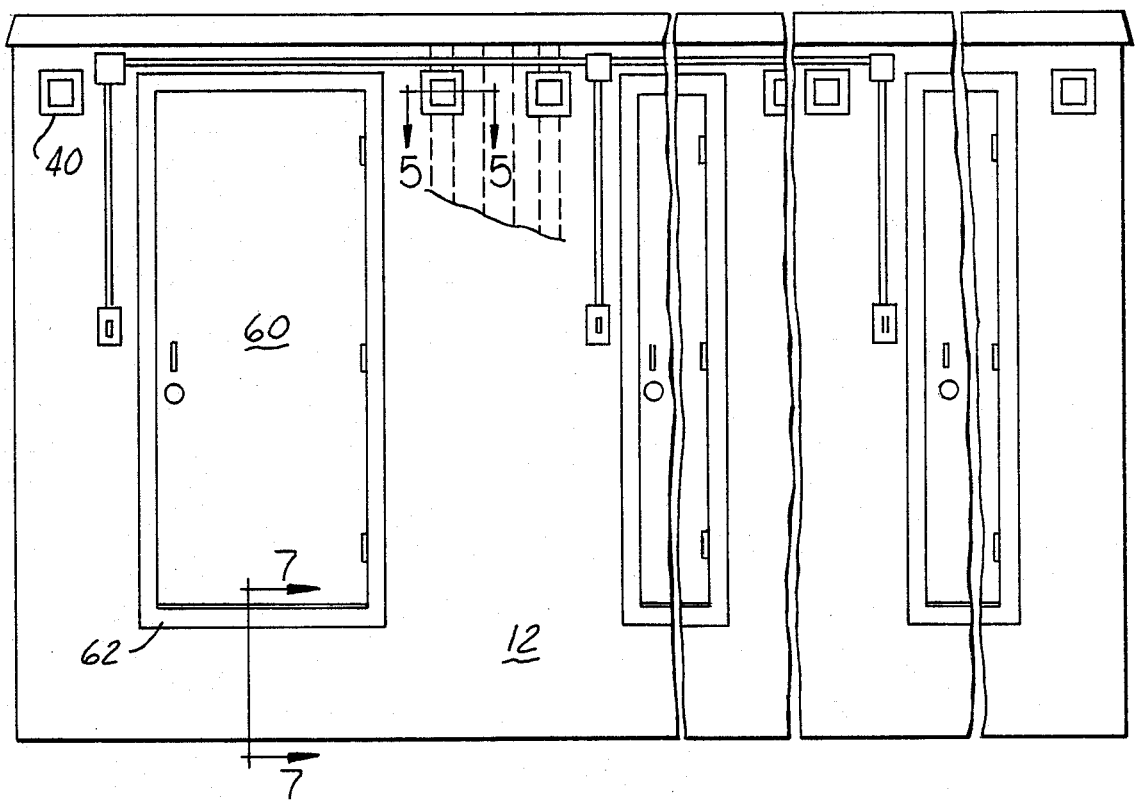

METHOD OF MAKING A HAZARDOUS WASTE SECONDARY STORAGE FACILITY

FIELD OF THE INVENTION

This invention relates to hazardous waste secondary storage containers and more particularly to a method of converting shipping containers into portable hazardous waste secondary storage facilities.

BACKGROUND

Hazardous waste facilities are used for, among other things, temporary and permanent storage of hazardous waste materials. These storage facilities are often of a permanent construction and do not afford the advantages associated with portable storage facilities.

Hazardous waste materials may be liquids, solids or gases and are often easily combustible. Accordingly, adequate ventilation must be provided to eliminate the possibility of combustion and to prevent a person working in the storage area from being overcome by fumes. Regulations have been developed which require storage facilities for combustable materials to be ventilated such that air is circulated in the storage facility and captured at a height no greater than 12 inches from the floor and exhausted therefrom.

Conversely, hazardous waste storage regulations have been developed which require storage facilities to have an impregnable periphery enclosing the stored material and designed to hold at least ten percent of the capacity of the material stored in the facility. Often, such an impregnable periphery has a height greater than 12 inches and therefore eliminates the possibility of utilizing a direct air exhaust port as a method of complying with the ventilation regulations.

Hazardous waste storage facilities of the prior art often are built on solid foundations such as concrete and thus are permanent fixtures. Such facilities are not desirable since circumstances may arise such as change in traffic flow, population density, and property values which would make it desirable to have a hazardous waste storage facility which could be easily picked up and transported to another location. Furthermore, since these facilities are permanent fixtures, they do not qualify for the tax advantages associated with portable equipment.

SUMMARY OF THE INVENTION

A method of making a portable hazardous waste storage facility preferably by converting a conventional shipping container. An air duct is placed inside or outside a conventional shipping container corrugation with an inlet located less than 12 inches from the container floor and an outlet for exhausting captured air outside to the atmosphere.

A fan is provided for producing a positive air flow through the facility. To provide self containment or retainment of at least ten percent of the material stored in the facility, a threshold dam or retainment barrier is provided inside and across the bottom of the conventional entryway of the shipping container. Preferably, additional entryways with doors are provided, each with a threshold above the floor of the container at a sufficient height to at least meet the containment requirements. Preferably each entryway door has a splash guard to prevent leakage around the closed door. Preferably all joints in the container are sealed to prevent leakage.

Objects, features and advantages of this invention are to provide a portable hazardous waste secondary storage facility which meets the requirements for storage of hazardous waste materials and the ventilation requirements for storage of toxic and combustible materials; does not need a foundation and is completely self-contained; can be made from conventional shipping containers; is easily assembled, rugged, durable and of economical manufacture and assembly; and qualifies for tax advantages associated with portable equipment.

BRIEF DESCRIPTION OF THE DRAWINGS

These and other objects, features and advantages of this invention will be apparent from the following detailed description, appended claims and drawings in which:

FIG. 1 is a perspective view of a conventional shipping container utilized in the present invention;

FIG. 2 is a fragmentary side view of a shipping container which has been converted into a hazardous waste storage facility in accordance with this invention demonstrating the ability to add doors of various configurations;

DETAILED DESCRIPTION

Figure 3:
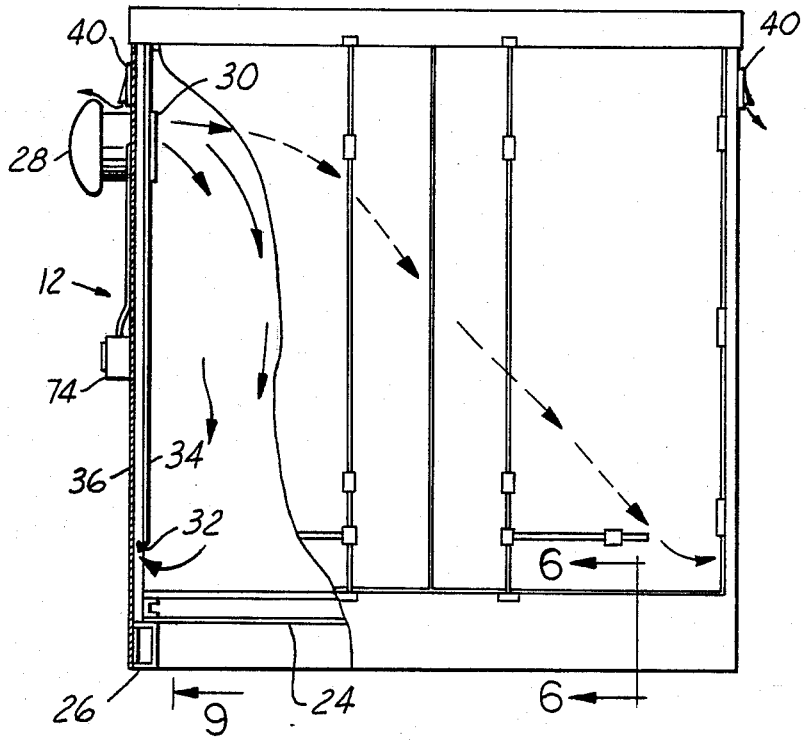
FIG. 3 is an end view with portions broken away and partially in section of the facility of FIG. 2.
Figure 4:
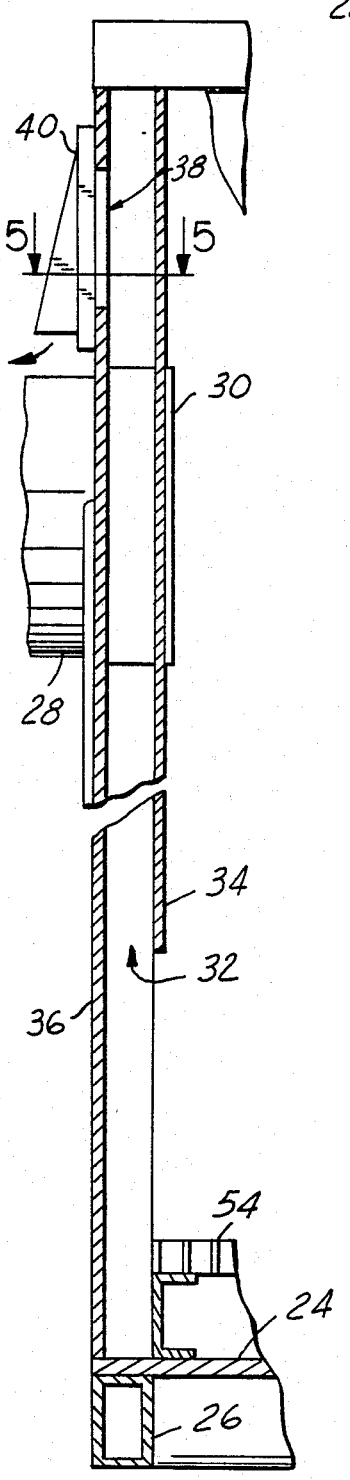
FIG. 4 is a fragmentary enlarged sectional view of a side wall of the facility of FIG. 2.
Figure 5:
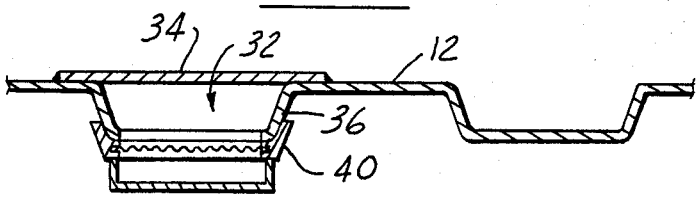
FIG. 5 is a fragmentary sectional view taken generally on line 5—5 of FIG. 4.

FIG. 1 shows a conventional shipping container 10 utilized in this invention. Typically these shipping containers are 8'6" high, 8 feet wide, and 20 or 40 feet in length. Usually these containers are formed from 14 gauge corrugated steel forming the sides 12, one end wall 14 and a roof 16. The other end wall 18 has a pair of outwardly swingable doors 20 and 22. The floor 24 is made of 1⅛ inch Marine quality wood timbers which prevent penetration by rodents, insects and the environs. The floor 24 is supported by U-shaped channels 26.

In order to meet the requirements for ventilation, an intake fan 28 is installed either in a side wall 12 or in the roof 16 of the container and has an associated metal grill guard 30. For the twenty foot containers, a 200 CFM fan is required to move 1 cubic foot of air per each square foot of floor space per minute through the container. For the forty foot containers, a 400 CFM fan is required to move 1 cubic foot of air per each square foot of floor space per minute through the container.

Figure 8:
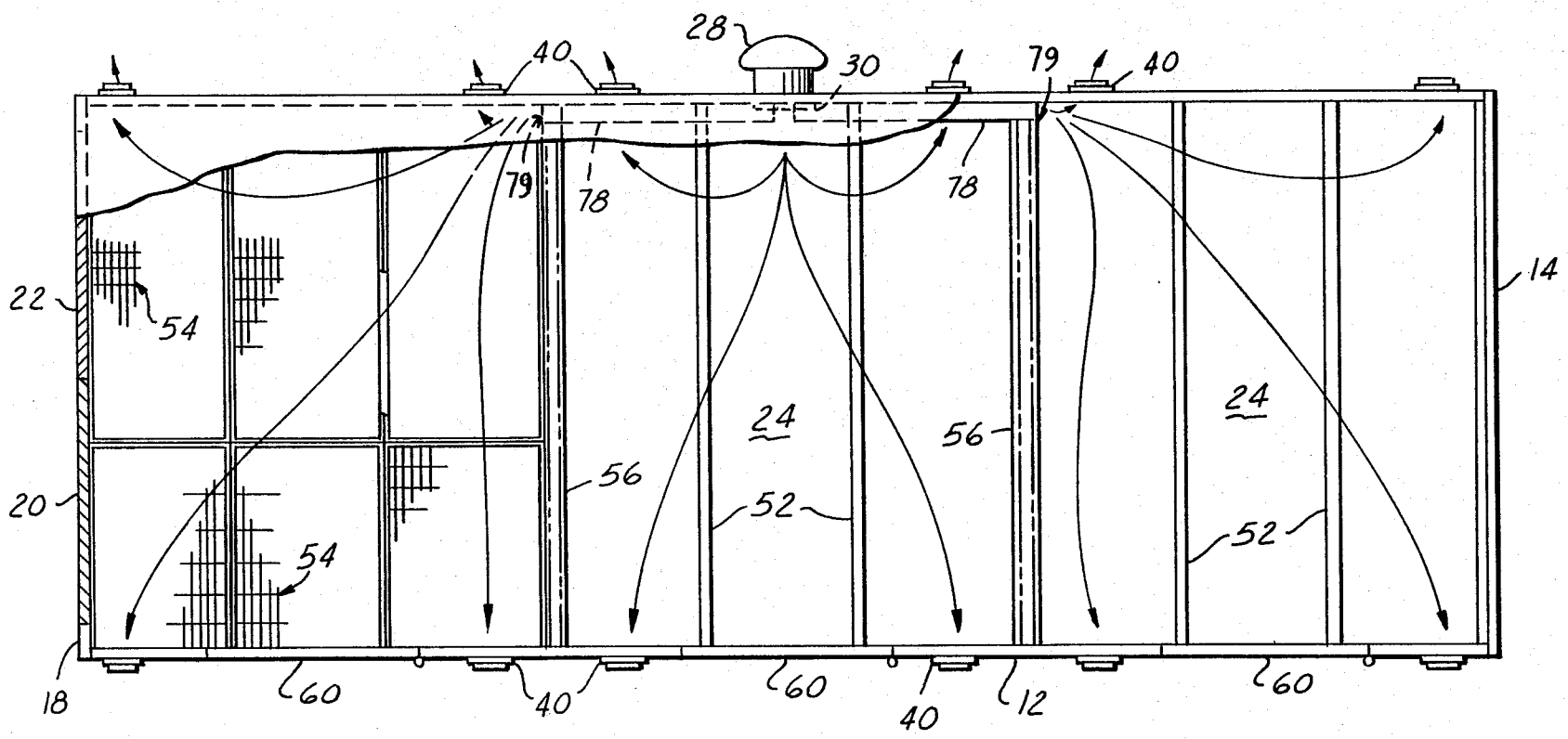
FIG. 8 is a top view with portions broken away and partially in section of the facility of FIG. 2.
Figure 9:
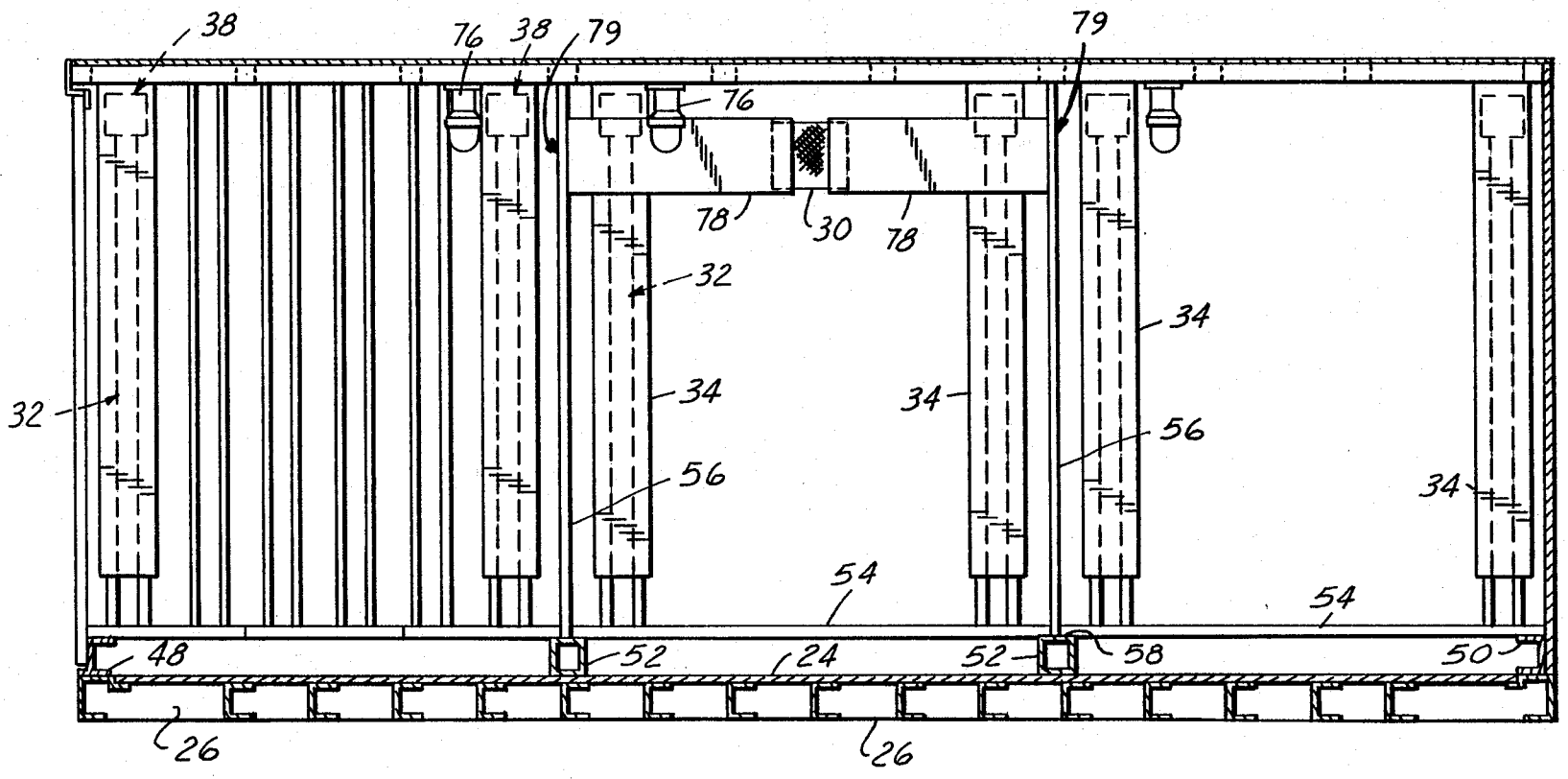
FIG. 9 is a sectional view taken generally along line 9—9 of FIG. 3 and illustrating a shipping container which has been converted into a modified hazardous waste secondary storage facility having multiple storage units therein.

As shown in FIG. 3, an exhaust duct 32 is formed preferably inside the container by placing a 16 gauge strip of sheet metal 34 over one of the vertically outwardly extending channels 36 of a corrugated side wall 12. The exhaust duct extends from a distance less than 12 inches from the floor to the roof of the container. At the top of this duct, an exhaust port 38, preferably a square three inches on each side, is cut near the roof of the container to provide an outlet for the air flowing up through the duct. Preferably, a metal grill 40, usually about 4 inches by 5 inches, is secured to the outside of the wall and overlying the port thereby preventing any debris or animals from entering the duct. Preferably, an exhaust duct is provided adjacent each corner of the container and every ten feet along each wall or minimally one duct in each corner if the container is divided into subcompartments. This arrangement allows air flow to extend in all directions, as shown in FIGS. 3 and 8, and greatly reduces or eliminates the chance of a pocket of combustible or toxic fumes developing in the facility. Furthermore, this exhaust duct construction prevents the discharge of hazardous material from a ruptured storage container that might occur if there was a direct air exhaust port near the floor.

Figure 6:
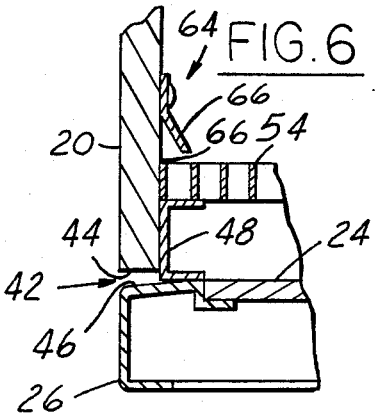
FIG. 6 is a fragmentary sectional view taken generally on line 6—6 of FIG. 3 and illustrating an end door, threshold dam and splash guard.

As shown in FIG. 6, the conventional shipping container has at one end two outwardly swinging end doors 20 & 22 which extend from generally the roof of the container to its floor. Naturally, there exists a clearance 42 between door bottom 44 of the end doors 20,22 and the end door threshold 46 such that the doors 20, 22 may swing freely. The end door threshold 46 is not raised sufficiently to retain at least 1/10 of the material stored in the container. Additionally, in the event that hazardous waste materials are spilled, it is desirable to keep the material out of contact with the people working in the facility.

To eliminate these problems, "C" channels 48, 50 are placed inside the container at each of its ends. Each channel transverses the entire width between the sides of the container and is held in place by continuous seam welding or other suitable means. The "C" channel truss 48 nearest the outwardly swinging end doors 20 & 22 also provides a dam or retainment barrier which prevents spilled material from flowing out the conventional end doors 20 & 22. At least one rectangularly shaped truss 52 may be disposed between the "C" channels to support partition walls 48, 50 and transverses the entire width of the sides of the container and is held in place by continuous seam welding or other suitable means. An open bar grate or commercial grade 1⅛ chemical resistant epoxy paint covered plywood 54 may be simply laid over the top of the trusses to provide an elevated floor.

The container may be sub-divided into a multitude of separate compartments by placing a vertically extending wall 56 in a desired location. The wall is supported by a rectangular shaped truss 52. Preferably, the wall has a thickness generally less than that of the truss so that a lip 58 is provided on each side of the truss on which a bar grate may rest. Preferably, the truss has a width of 4 inches and the walls have a thickness of 16 or 14 gauge steel.

Figure 7:
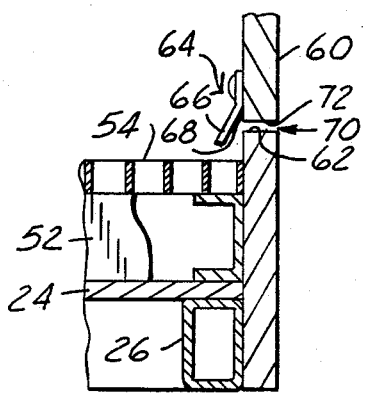
FIG. 7 is a fragmentary sectional view taken generally along line 7—7 of FIG. 2 and illustrating a side entry door and splash guard.

When desired, the conventional shipping container can be sub-divided into a multitude of compartments each being equipped with the modifications described hereinabove as shown in FIGS. 2, 7 & 8. When the container is sub-divided into a multitude of compartments, air may be induced into the container by a single fan or by multiple fans. When a single fan is utilized, fan ducts 78 are provided leading from the fan inlet to a port 79 provided in each compartment wall 56 generally near the roof. As shown in FIG. 8, this arrangement allows air to be induced into each compartment generally near the roof and flow downwardly across the floor and up the exhaust duct.

The Marine quality wood floor 24 of the conventional container ensures that any spilled materials do not escape the facility by penetration. Furthermore, such a floor is effective in preventing penetration of the facility by rodents, insects and the environs. Alternatively, the floor may be covered with an impregnable material such as metallic sheet, plastic membrane or coating, concrete or similar material, to provide additional protection against the environs or chemicals. If desired, the floor may be constructed entirely from metal.

All joints in the container are sealed by welding or an impregnable caulking material so as to provide a completely closed container capable of retaining any spill of hazardous material and to ensure the desired direction of air circulation is achieved.

Additional entry doors 60 may be provided in the container. The threshold 62 for the door 60 is elevated to a sufficient height to retain at least 1/10 of the volumetric capacity of the container. Generally, a threshold height of 4 inches is sufficient to provide such retainment.

As shown in FIGS. 6 and 7, an angled steel splash guard 64 is permanently fixed to the inside of each door 20, 22, 60. The guard has a leg 66 which extends away from the door and downwardly a length equal to or less than the bottom of the door. In the event that hazardous material is splashed onto the door by a ruptured storage container, this splash guard prevents any hazardous waste material from dripping down the face of the door 68 and out the clearance 42, 70 between the door bottom 44, 72 and the door threshold 46, 62. This splash guard causes the splashed material to drip down the inner face of its leg 66 into the retainment area and away from the clearance 42, 70 provided between the bottom 44, 72 of the door and the threshold 46, 62.

Preferably, all installations are constructed from corrosive resistant materials and are preferably treated with a corrosive resistant coating. The facility may be equipped with explosion proof electrical connections 74, including light fixtures 76, fire sprinkler system, dry chemical fire suppression system, pressure relief blow out panels, safety shower/eye wash units, spill sub-pump, etc., as desired.

The container may be provided with entryways and windows having dimensions suitable for each desired purpose of use.

I claim:

1. A method of converting a conventional shipping container, of the type constructed from corrugated steel to form sides, an end wall and a roof, the other end wall having outwardly swingable doors, and said container having a floor, which comprises:

placing a fan generally adjacent the roof of said container capable of inducing air flow through said container, providing at least one exhaust duct by fixing a strip of material over one of the generally vertical extending channels of said corrugated wall and extending generally from the roof of the container to a distance generally less than 12 inches from the floor of said container, providing an outlet in said duct constructed and arranged such that air induced into the container may flow up the duct formed by said strip and channel and out said container through said outlet, sealing all joints in said container, and placing a dam in said container immediately adjacent its outwardly swingable doors, said dam extending traversely between the sides of the container and constructed and arranged to form an impregnable periphery capable of retaining at least 10 percent of the material storage capacity of the facility.

2. The method of converting a conventional shipping container set forth in claim 1 further comprising:

placing two opposed C-shaped channels immediately adjacent the inner ends of the container wherein one of said C-shaped channels forms said dam, said trusses being constructed and arranged to carry a grating.

3. The method of converting a conventional shipping container set forth in claim 2 further comprising:

placing in the container an intercompartment wall extending traversely between the sides of said container and carried by a rectangular shaped truss, said wall having a width less than the width of said rectangular shaped truss and constructed and arranged such that when the wall is placed thereon, a lip is provided on each side of the rectangular truss for carrying a grating, and providing an air duct extending generally from said fan to a port hole in said intercompartment wall generally near the roof of said container and constructed and arranged such that when a single fan is provided, air induced into the container by said fan will flow through said duct into the adjacent compartment formed by said wall and generally downwardly across the floor of said adjacent compartment and up said exhaust duct.

4. The method of converting a conventional shipping container set forth in claim 1 further comprising placing said exhaust duct in each of the corners of each compartment constructed and arranged to produce air flow inside the container in all directions.

5. The method of converting a conventional shipping container set forth in claim 1 further comprising:

providing a side entry door in said container having a threshold located a distance above said floor of the container sufficient to provide retainment of at least 10 percent of the the material storage capacity of the facility.

6. The method of converting a conventional shipping container as set forth in claim 5, further comprising:

providing an angled splash guard carried by and generally adjacent the bottom of each said entry door, extending downwardly and away from each said door, and constructed and arranged such that any material splashed onto such door will flow down the inner face of such door, over the face of the splash guard and away from any clearance provided between the bottom of said entry door and associated door threshold.

7. The method of converting a conventional shipping container as set forth in claim 1, further comprising:

providing an angled splash guard carried by and generally adjacent the bottom of each said outwardly swingable door, extending downwardly and away from each said door, and constructed and arranged such that any material splashed onto such door will flow down the inner face of such door, over the face of the splash guard and away from the associated door dam.

8. The method of converting a conventional shipping container set forth in claim 1 further comprising:

placing a grating over said exhaust port constructed and arranged to prevent debris and animals from entering said exhaust duct.

9. The method of converting a conventional shipping container set forth in claim 1 further comprising:

providing said floor constructed from Marine quality wood.

10. The method of converting a conventional shipping container set forth in claim 9 further comprising covering said floor with an impregnable material.

11. A storage facility made by the process of providing a conventional shipping container, of the type constructed from corrugated steel to form sides, one end wall and a roof, the other end wall having outwardly swingable doors, and said container having a floor, and thereafter placing a fan generally adjacent the roof of said container capable of inducing air flow through said container, providing at least one exhaust duct by fixing a strip of material over one of the outwardly extending channels of said corrugated wall and extending generally from the roof of the container to a distance generally less than 12 inches from the floor of said container, providing an outlet in said duct generally constructed and arranged such that said air induced into the container may flow up the duct formed by said strip and channel and out said container through said outlet, sealing all joints in said container, and placing a dam in said container immediately adjacent its outwardly swingable doors, said dam extending traversely between the sides of the container and constructed and arranged to form an impregnable periphery capable of retaining at least 10 percent of the material storage capacity of the facility.

12. A storage facility as set forth in claim 11 also made by placing two opposed C-shaped channels immediately adjacent the inner ends of the container wherein one of said C-shaped channels forms said dam, said trusses being constructed and arranged to carry a grating.

13. A storage facility as set forth in claim 12 also made by placing an intercompartment wall in the container extending traversely between the sides of said container having a width sufficiently small enough so as to be carried by a rectangular shaped truss and constructed and arranged such that when the wall is placed over the middle of said rectangular truss, a lip is provided on each side of said rectangular truss for carrying a bar grating, and providing an air duct extending generally from said fan to a port hole in said intercompartment wall generally near the roof of said container constructed and arranged such that when a single fan is provided, air induced into the container by said fan will flow through said duct system into the adjacent compartment formed by said wall and generally downwardly across the floor of said adjacent compartment and up said exhaust duct.

14. A storage facility as set forth in claim 13 also made by placing said exhaust duct in each of the corners of each compartment, constructed and arranged to produce air flow inside the container in all directions.

15. A storage facility as set forth in claim 11 also made by providing a side entry door in said container having a threshold located a distance from said floor of the container sufficient to provide retainment of at least 10 percent of the material storage capacity of the facility.

16. A storage facility as set forth in claim 15 also made by providing an angled splash guard carried by and generally adjacent the bottom of each said entry door, extending downwardly and away from each said door, and constructed and arranged such that any material splashed onto such door will flow down the inner face of such door, over the face of the splash guard and away from any clearance provided between the bottom of said side entry door and associated door threshold.

17. A storage facility as set forth in claim 11 also made by providing an angled splash guard carried by and generally adjacent the bottom of each said outwardly swingable door, extending downwardly and away from each said door, and constructed and arranged such that any material splashed onto such door will flow down the inner face of such door, over the face of the splash guard into the retainment area and away from the associated door dam.

18. A storage facility as set forth in claim 11 also made by placing a grating over said port constructed and arranged to prevent debris and animals from entering said exhaust duct.

19. A storage facility as set forth in claim 11 wherein said floor is constructed from Marine quality wood.

20. A storage facility as set forth in claim 19 also made by covering said floor with an impregnable material.

* * * * *